US010167120B1

(12) United States Patent
Levy et al.

(10) Patent No.: US 10,167,120 B1
(45) Date of Patent: Jan. 1, 2019

(54) TRAVEL BOTTLE WITH TWISTING LOCKING LID

(71) Applicant: Navajo Manufacturing Company, Inc., Denver, CO (US)

(72) Inventors: Gordon Levy, Golden, CO (US); Shawn Shelton, Denver, CO (US)

(73) Assignee: Navajo Manufacturing Company, Inc., Denver, CO (US)

( * ) Notice: Subject to any disclaimer, the term of this patent is extended or adjusted under 35 U.S.C. 154(b) by 0 days.

(21) Appl. No.: 15/900,016

(22) Filed: Feb. 20, 2018

(51) Int. Cl.
*B65D 50/06* (2006.01)
*B65D 47/20* (2006.01)

(52) U.S. Cl.
CPC ..... *B65D 50/06* (2013.01); *B65D 47/2006* (2013.01); *B65D 2255/00* (2013.01)

(58) Field of Classification Search
CPC ..... B65D 47/2006; B65D 47/2012; B65D 47/26; B65D 47/266; B65D 47/268; B65D 51/18; B65D 55/02; B65D 55/12; B65D 50/06; B65D 2215/04; B65D 2251/1016; B65D 2255/00; B65D 2555/02
USPC ..... 222/153.14
See application file for complete search history.

(56) References Cited

U.S. PATENT DOCUMENTS 3,094,255 A * 6/1963 Hunter ..... A47G 19/32 222/507
3,358,890 A * 12/1967 Dalfo ..... B65D 47/2012 222/507
3,460,719 A * 8/1969 O'Donnell ..... B65D 83/205 222/320
3,484,023 A * 12/1969 Meshberg ..... B65D 83/205 222/402.11
3,655,099 A * 4/1972 Hazard ..... B65D 47/305 222/153.06
3,702,165 A 11/1972 Carow et al.
3,784,060 A * 1/1974 Hazard ..... B65D 47/305 222/153.14
3,847,313 A * 11/1974 Micallef ..... B65D 47/2012 222/153.14
3,848,778 A * 11/1974 Meshberg ..... B65D 83/205 222/402.11
3,873,005 A * 3/1975 Hazard ..... B65D 47/305 222/153.14
3,874,568 A * 4/1975 La Vange ..... B65D 47/305 222/505
4,047,643 A 9/1977 Hazard
4,081,113 A * 3/1978 Hazard ..... B65D 47/305 222/534
4,299,339 A * 11/1981 Giroux ..... B65D 47/265 215/313
4,487,342 A * 12/1984 Shy ..... B65D 47/2006 222/481.5
4,500,016 A * 2/1985 Funfstuck ..... B65D 47/265 222/153.14
4,542,837 A * 9/1985 Rayner ..... B65D 83/206 222/402.11

(Continued)

*Primary Examiner* — Patrick M. Buechner
(74) *Attorney, Agent, or Firm* — Studebaker & Brackett PC

(57) ABSTRACT

A bottle includes a secure sealing mechanism. A twisting locking lid secured onto a bottle maintains the contents of the bottle. This is achieved by securing a dispensing mechanism in a closed, locked position and sealing an outlet so that any liquids being forced into a dispensing channel are held within the channel.

20 Claims, 5 Drawing Sheets

(56) References Cited

U.S. PATENT DOCUMENTS

| | | | | | |
|---|---|---|---|---|---|
| 4,591,079 | A * | 5/1986 | Bigotte | B65D 47/2012 | 222/505 |
| 4,645,086 | A * | 2/1987 | Rosenthal | B65D 47/268 | 215/235 |
| 4,776,501 | A * | 10/1988 | Ostrowsky | B65D 47/2006 | 215/235 |
| 4,779,773 | A * | 10/1988 | Bennett | B65D 47/2012 | 215/313 |
| 4,962,869 | A * | 10/1990 | Gross | B65D 47/2006 | 222/153.14 |
| 5,141,129 | A * | 8/1992 | Jennings | B65D 50/061 | 206/536 |
| 5,284,264 | A * | 2/1994 | Gross | B65D 55/02 | 215/206 |
| 5,314,093 | A | 5/1994 | Gross et al. | | |
| 5,622,284 | A | 4/1997 | Sawicki | | |
| 5,649,645 | A | 7/1997 | Demarest et al. | | |
| 6,896,160 | B2 | 5/2005 | Kaufman et al. | | |
| 6,971,547 | B2 | 12/2005 | Englert et al. | | |
| 9,382,059 | B2 | 7/2016 | Selinger et al. | | |
| 2003/0038146 | A1 * | 2/2003 | Meshberg | B05B 11/3059 | 222/153.13 |
| 2004/0112927 | A1 * | 6/2004 | Kaufman | B65D 47/2006 | 222/531 |

* cited by examiner

TRAVEL BOTTLE WITH TWISTING LOCKING LID

FIELD OF THE INVENTION

The present invention relates to the field of bottles which require a secure locking to prevent accidental dispensing of its contents.

BACKGROUND OF THE INVENTION

Oftentimes, when traveling, individuals carry miniaturized versions of full sized liquid content bottles. However, the problem encountered is that the small, travel size bottles often leak or accidentally dispense fluids due to contact with the bottle or pressurization of an airline compartment which forces liquids from the bottle. This causes a mess throughout all of the travel contents.

SUMMARY OF THE INVENTION

By the present invention, a bottle includes a secure sealing mechanism. A twisting locking lid secured onto a bottle maintains the contents of the bottle. This is achieved by securing a dispensing mechanism in a closed, locked position and sealing an outlet so that any liquids being forced into a dispensing channel are held within the channel.

This is achieved by the use of a bottle cap that can be opened and closed. When in the closed position the bottle is "locked" by a twisting of a top half of the cap to a locked position. The locked position is indicated by markings on the top of the cap.

The top half of the cap is a separate body from the bottom half of the cap. The top half is twistable through 45° from an unlocked position to a locked position and vice a versa. In the unlocked position of the upper cap a pivotal plate is moved approximately 25° to allow fluid to flow out through a dispensing channel in the body.

The bottom half of the cap is designed with a rough texture to provide a grip. The grip makes it easier to twist the cap tightly onto the bottle. It also differentiates the bottom half of the cap from the top half of the cap.

When the top half of the cap is twisted 45° to a locked position, the top half of the cap covers the outlet channel of the valve body. This restricts movement of the pivoting plate and keeps the contents of the bottle from being dispensed under pressure.

Accordingly, it is an object of the present invention to provide a travel bottle with a twisting locking lid.

It is another object of the present invention to provide a travel bottle with a twisting locking lid divided into two portions, with the upper portion being rotatably mounted 45° between a closed, locked position and an open, dispensing position.

It is still yet another object of the present invention to provide a travel bottle with the twisting locking lid divided into two portions, with the upper portion being rotatably mounted 45° between a closed, locked position and an open, dispensing position, with the open dispensing position allowing pivotal movement of a dispensing plate having a dispensing channel for passage of the contents of the bottle.

It is still another object of the present invention to provide a travel bottle with the twisting locking lid divided into two portions, with the upper portion being rotatably mounted 45° between a closed, locked position and an open, dispensing position, with the open dispensing position allowing pivotal movement of a dispensing plate having a dispensing channel for passage of the contents of the bottle and in the closed, locked position preventing pivotal movement of the dispensing plate to seal the liquid contents within the bottle.

These and other objects of the invention, as well as many of the intended advantages thereof, will become more readily apparent when reference is made to the following description taken in conjunction with the accompanying drawings.

BRIEF DESCRIPTION OF THE DRAWINGS

The following drawings illustrate examples of various components of the invention disclosed herein, and are for illustrative purposes only. Other embodiments that are substantially similar can use other components that have a different appearance.

DETAILED DESCRIPTION OF THE PREFERRED EMBODIMENTS

Figure 1:
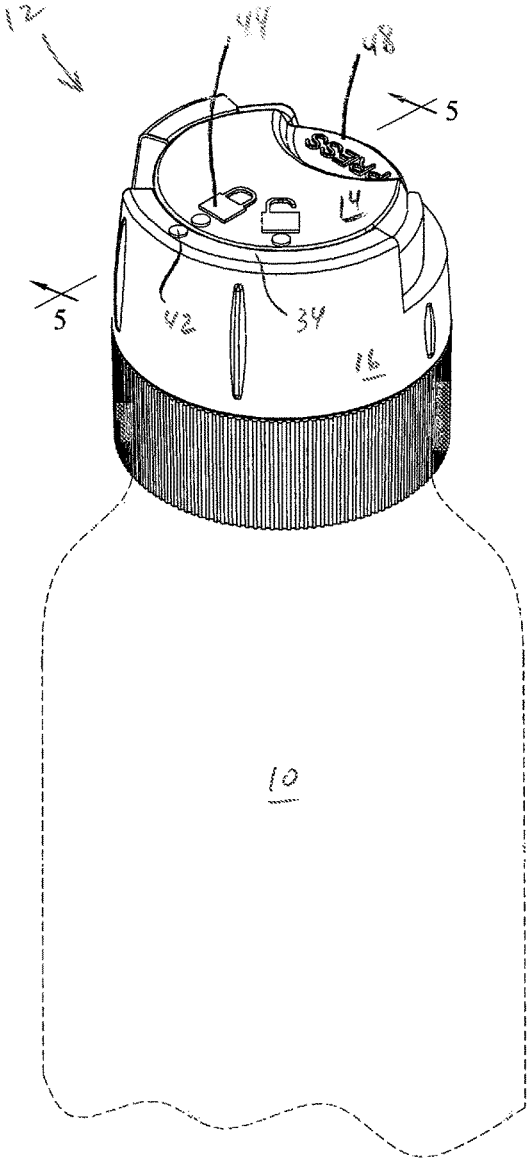
FIG. 1 illustrates the twisting locking lid of the present invention mounted on a bottle in a locked position.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
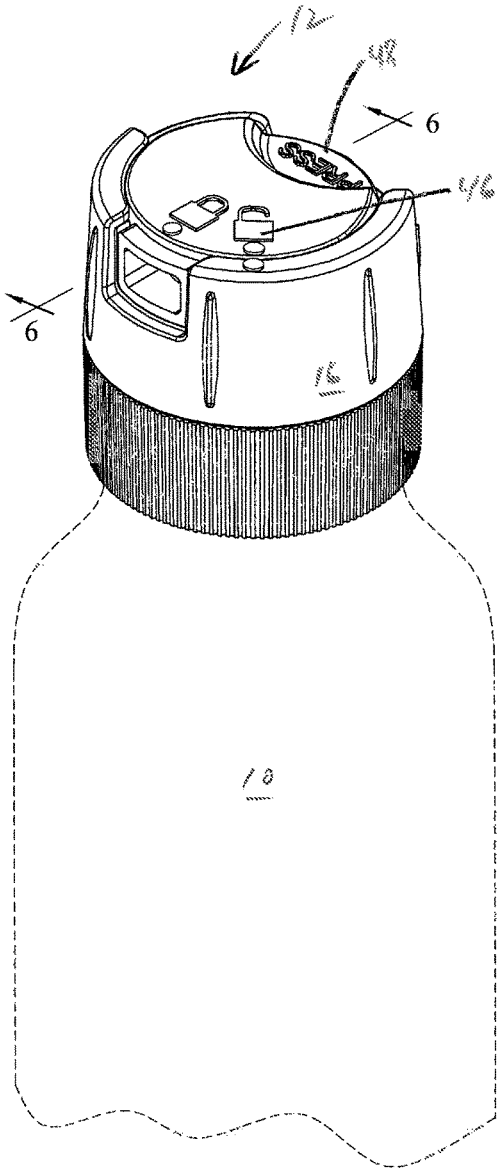
FIG. 2 illustrates the twisting locking lid of the present invention mounted on a bottle in an unlocked position.
Figure 3:
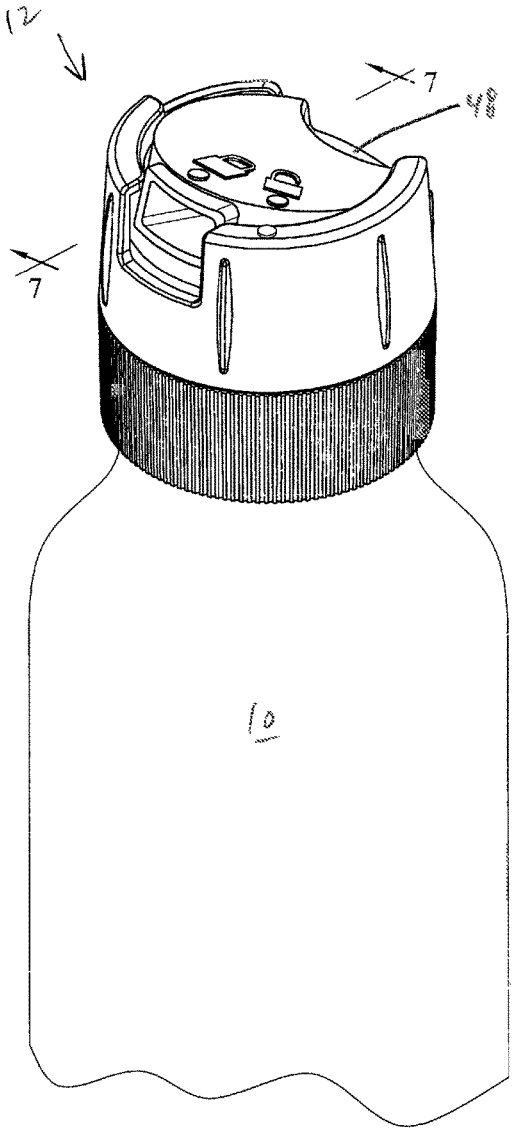
FIG. 3 illustrates the twisting locking lid in an unlocked position and a pivotal dispensing plate pivoted into a dispensing position.

As shown in FIGS. 1 through 3, a travel bottle 10 includes a twisting locking lid 12 shown in various positions amongst the three figures. FIG. 1 represents a closed, locked position of the locking lid. FIG. 2 represents an unlocked position of the locking lid. FIG. 3 represents an unlocked position of the locking lid with a dispensing plate pivoted into a dispensing position.

Figure 4:
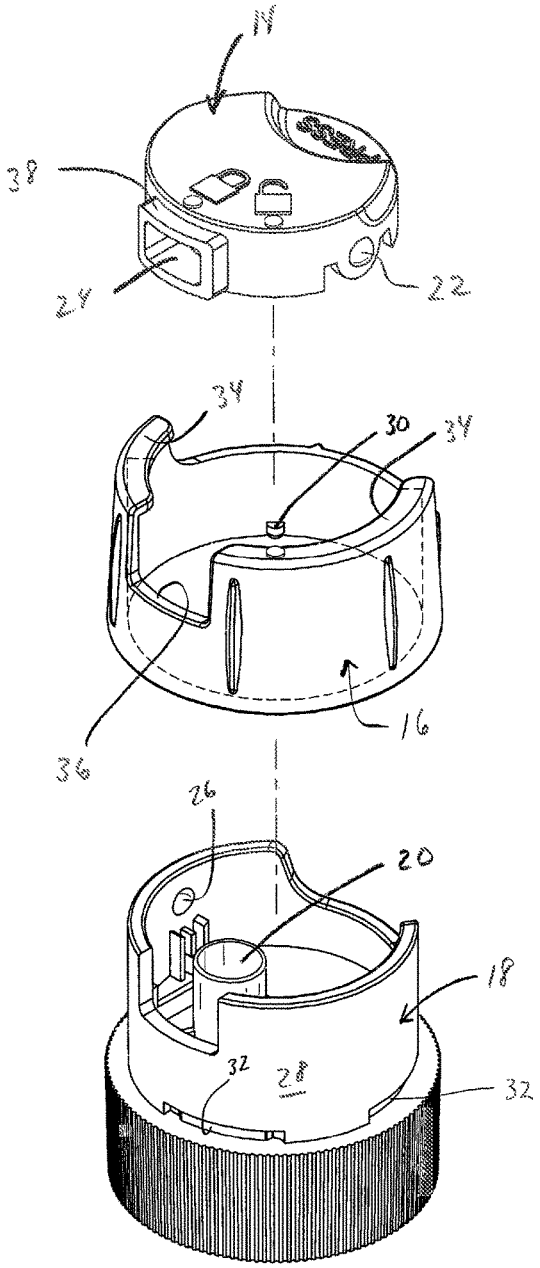
FIG. 4 is an exploded view of the twisting locking lid.
Figure 5:
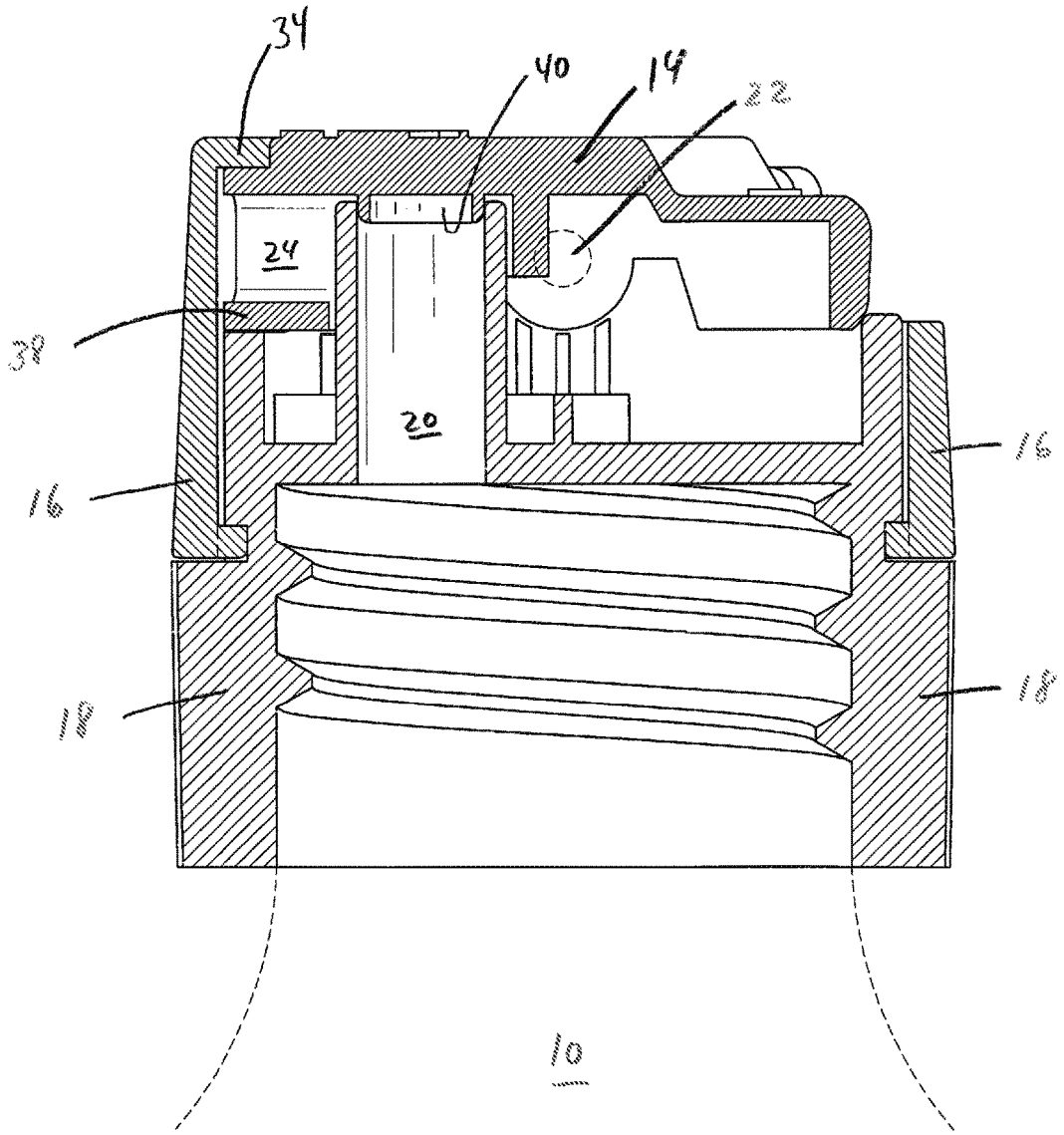
FIG. 5 is a sectional view taken along line 5-5 as shown in FIG. 1.

As shown in FIG. 4, the locking lid 12 includes three components. The locking lid includes a dispensing plate or valve body 14 pivotally mounted in an upper portion or twisting ring body 16 of the twisting lid 12. A lower portion or main body 18 of the twisting lid 12 includes a passageway 20 through which fluid may flow from the bottle 10.

The dispensing plate 14 is pivotally mounted in the upper portion 16 by opposed projections 22 located on opposite sides of the dispensing plate. Similarly shaped recesses 26 are located on the interior wall of the main body. An outlet passageway 24 is shown which aligns with passageway 20 of lower portion 18.

The twisting ring body 16 is rotatably mounted about a recessed portion 28 of main body 18. While valve body 14 is pivotally mounted with respect to main body 18, twisting ring body 16 is rotatable through an angle of approximately 45° to block outlet passageway 24 in a locked position and to open outlet passageway 24 in an open position. When in the open position, the valve body 14 is required to be pivoted upwardly to allow passage of liquids through the passageway 20 and into the outlet passageway 24.

The twisting ring body includes four projections 30 which snap into grooves 32 so as to guide rotation of the twisting ring body 16 about the circumference of the main body 18. To further assist in the mounting of the twisting ring body 16 on the main body 18, radially inwardly projecting ledges 34 extend over the valve body 14 to hold it in place on the main body 18.

It is only when the twisting ring body 16 is rotated to position U-shaped opening 36 in front of outlet passageway 24 is the rectangular portion 38 allowed to be pivoted upwardly in the direction of the open portion of the U-shaped opening to allow extension of the rectangular portion 38 above the upper edge of ledges 34 for dispensing a product of the bottle 10. This is best shown in FIG. 3.

Figure 6:
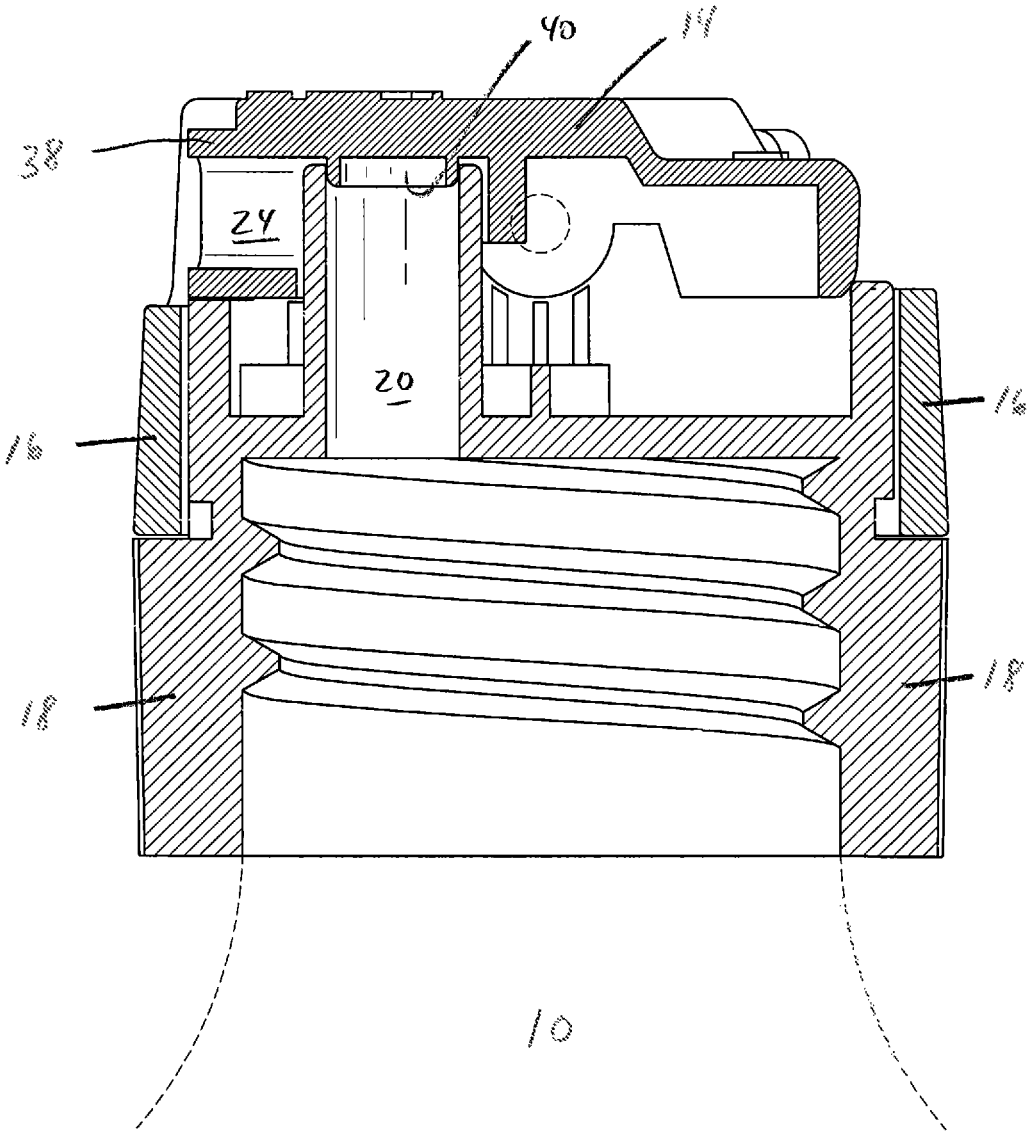
FIG. 6 is a sectional view taken along line 6-6 as shown in FIG. 2.
Figure 7:
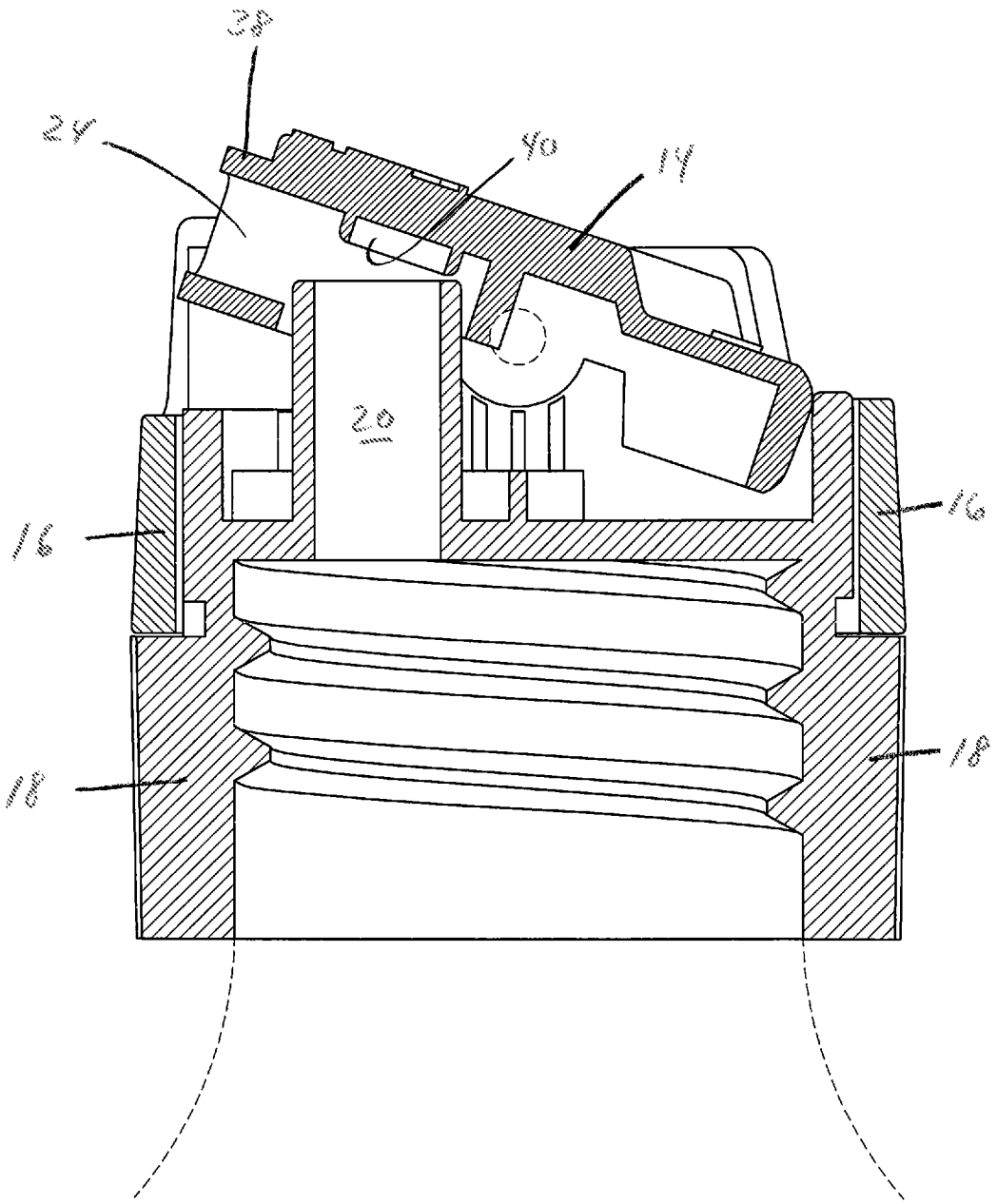
FIG. 7 is a sectional view taken along line 7-7 as shown in FIG. 3.

Due to the pivoting of the valve body, a projection 40 of the valve body is allowed to pivot away from passageway 28 as shown in FIG. 6 to the position shown in FIG. 7. This allows for passage of liquids in the bottle 10 to move through passageway 20 and into passageway 24. This is not possible without the pivoting of the valve body 14.

As shown in FIG. 1, when the twisting locking lid is in the fully locked position, a marker 42 on ledge 34 aligns with a "lock" icon 44 on the valve body 14. However, when the twisting ring body 16 is rotated by 45° as shown in FIG. 2, the marker 42 is aligned with an "unlocked" icon 46 to visually demonstrate that the twisting lock lid is in an open position. At this point, as shown in FIG. 3, the valve body may be depressed at finger recess 48 labeled with the term "PRESS" so as to remove the projection 40 and to align passageway 20 with outlet passageway 24 and thereby remove contents from bottle 10 upon inversion of bottle 10 and squeezing of bottle 10.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

We claim:

1. A cap of a dispensing bottle, said cap comprising
a main body,
a valve body pivotably mounted on the main body, and
a twisting ring body rotatably mounted on the main body, said twisting ring body mounting said valve body in a fixed position on said main body in a locked position of said twisting ring body and said twisting ring body allowing said valve body to be pivoted on said main body in an unlocked position of said twisting ring body.

2. The cap of a dispensing bottle according to claim 1, wherein said twisting ring body includes a radially inwardly projected ledge prevents pivoting of said valve body on said main body when said twisting ring body is in said locked position.

3. The cap of a dispensing bottle according to claim 1, wherein said valve includes a locked icon and an unlocked icon.

4. The cap of a dispensing bottle according to claim 1, wherein said twisting ring y is rotatable 45° between the locked position and the unlocked position.

5. The cap of a dispensing bottle according to claim 1, wherein grooves in said main body cooperate with projections in said twisting ring body to guide rotation of the twisting ring body and to limit rotation of said twisting ring body.

6. The cap of a dispensing bottle according to claim 1, wherein said main body includes a passageway for liquid from the dispensing bottle, said passageway being blocked by said valve body in said locked position of said twisting ring body.

7. The cap of a dispensing bottle according to claim 6, wherein said valve body includes a plate blocking said passageway of said main body in said locked position of said twisting ring body.

8. The cap of a dispensing bottle according to claim 7, wherein said valve body includes an outlet in communication with said passageway of said main body when said twisting body is in said unlocked position and said valve body has been pivoted on said main body.

9. The cap of a dispensing bottle according to claim 8, wherein said twisting ring body includes a gap in an outer sidewall alignable with said outlet of said valve body in said unlocked position.

10. The cap of a dispensing bottle according to claim 9, wherein said outlet of said valve body is pivoted through said gap in said twisting ring body when said twisting ring body is in the unlocked position.

11. A cap of a dispensing bottle, said cap comprising
a main body,
a valve body pivotably mounted on the main body, and
a twisting ring body rotatably mounted on the main body, said twisting ring body mounting said valve body in a fixed position on said main body in a locked position of said twisting ring body and said twisting ring body allowing said valve body to be pivoted on said main body in an unlocked position of said twisting ring body,
said twisting ring body including a radially inwardly projected ledge, said radially inwardly projecting ledge extending only partially around a circumference of said main body.

12. The cap of a dispensing bottle according to claim 11, wherein said main body includes a passageway for liquid from the dispensing bottle, said passageway being blocked by said valve body in said locked position of said twisting ring body.

13. The cap of a dispensing bottle according to claim 11, wherein said valve body including a plate blocking said passageway of said main body in said locked position of said twisting ring body.

14. The cap of a dispensing bottle according to claim 11, wherein said radially inwardly projected ledge prevents pivoting of said valve body on said main body when said twisting ring body is in said locked position.

15. The cap of a dispensing bottle according to claim 11, wherein said valve includes a locked icon and an unlocked icon.

16. The cap of a dispensing bottle according to claim 11, wherein said twisting ring y is rotatable 45° between the locked position and the unlocked position.

17. The cap of a dispensing bottle according to claim 11, wherein grooves in said main body cooperate with projections in said twisting ring body to guide rotation of the twisting ring body and to limit rotation of said twisting ring body.

18. The cap of a dispensing bottle according to claim 11, wherein said valve body includes an outlet in communication with said passageway of said main body when said twisting ring body is in said unlocked position and said valve body has been pivoted on said main body.

19. The cap of a dispensing bottle according to claim 18, wherein said twisting ring body includes a gap in an outer sidewall alignable with said outlet of said valve body in said unlocked position.

20. The cap of a dispensing bottle according to claim 19, wherein said outlet of said valve body is pivoted through said gap in said twisting ring body when said twisting ring body is in the unlocked position.

* * * * *